US005758777A

United States Patent [19]

Dods

[11] Patent Number: 5,758,777

[45] Date of Patent: Jun. 2, 1998

[54] FIGURINE PACKAGE

[75] Inventor: Robert E. Dods, Burr Ridge, Ill.

[73] Assignee: Racing Champions, Inc., Glen Ellyn, Ill.

[21] Appl. No.: 666,937

[22] Filed: Jun. 19, 1996

[51] Int. Cl.[6] ..... B65D 25/00; B65D 65/16; A63H 3/00

[52] U.S. Cl. ..... 206/776; 206/232; 206/457; 206/765; 446/73

[58] Field of Search ..... 206/457, 232, 206/765, 776, 783; 446/72, 73, 75, 77

[56] References Cited

U.S. PATENT DOCUMENTS

| | | | |
|---|---|---|---|
| 2,636,597 | 4/1953 | Hinz | 446/73 X |
| 3,324,997 | 6/1967 | Bonanno | 206/232 X |
| 3,406,816 | 10/1968 | Green et al. | 206/776 X |
| 3,459,294 | 8/1969 | Crosman et al. | 206/457 |
| 3,533,503 | 10/1970 | Wood et al. . | |
| 3,586,349 | 6/1971 | Green et al. | 206/232 X |
| 3,731,420 | 5/1973 | Crosman | 446/73 |
| 3,847,276 | 11/1974 | Lehner et al. . | |
| 3,945,494 | 3/1976 | Weber et al. . | |
| 4,122,947 | 10/1978 | Falla . | |
| 4,176,473 | 12/1979 | Rae . | |
| 4,199,058 | 4/1980 | Lense et al. . | |
| 4,213,531 | 7/1980 | Rae . | |
| 4,700,831 | 10/1987 | Kassar | 206/232 |
| 4,905,828 | 3/1990 | Dods | 206/335 |
| 4,913,284 | 4/1990 | Versaci . | |
| 4,976,351 | 12/1990 | Mangini et al. . | |
| 5,040,671 | 8/1991 | Hager . | |
| 5,147,043 | 9/1992 | Gould . | |
| 5,186,319 | 2/1993 | Ting | 446/73 X |
| 5,263,586 | 11/1993 | Keable . | |
| 5,267,756 | 12/1993 | Molee et al. . | |
| 5,306,049 | 4/1994 | Schireck . | |

FOREIGN PATENT DOCUMENTS

| | | |
|---|---|---|
| 547518 | 6/1993 | European Pat. Off. . |

*Primary Examiner*—Bryon P. Gehman
*Attorney, Agent, or Firm*—Reinhart, Boerner, Van Deuren, Norris & Rieselbach, s.c.

[57] ABSTRACT

A package comprising a figurine and a model book or a model magazine bearing information relating to the figurine. The model book or the model magazine preferably comprises a small replica comic book featuring a character represented by the figurine. One preferred embodiment includes a display stand for the figurine with the model book or the model magazine coupled to the display stand. A transparent front and rear cover can enclose and support the model book or the model magazine in a visually attractive position relative to the figurine.

25 Claims, 3 Drawing Sheets

FIGURINE PACKAGE

BACKGROUND OF THE INVENTION

The present invention relates generally to a package of a figurine and related products. More particularly, the present invention relates to a package including a figurine, a model book or a model magazine bearing information related to the figurine and a display stand. In one preferred embodiment of the invention, the package includes the figurine, a replica comic book featuring a character upon which the figurine is modeled and the display stand.

Historically, collectible items have been displayed individually in closely supervised areas of retail stores. As floor space and display area costs have increased significantly, manufacturers have strived to design improved packages which securely retain the products in compact and attractive display configurations. Manufacturers have found multiple piece products particularly difficult to securely and attractively package. Additionally, collectible items such as figurines often have preferred display orientations which further complicate packaging requirements.

Consumers prefer to view a multiple piece collectible item in the preferred display position prior to purchasing the item. A collectible item with multiple pieces in separate packaging forces the consumer to rely on his or her imagination to visualize the final displayed arrangement. Therefore, integrated packaging improves the collectible item's allure and gives retailers a more salable product.

Rare or old comic books are popular and commonly market as collectible items. Generally, collectible items and other nostalgic goods gain monetary value over time as the items become more distinctive. The combination of a unique periodical and a limited edition package adds rarity and value to the periodical.

Furthermore, collectors seek attractive displays to enhance the visual appeal of their collections. Comic books are typically thin paperback periodicals and thus are difficult to prominently display. A display which juxtaposes two-dimensional drawings and words of a book or replica thereof with a three-dimensional figurine provides a highly desirable collectible product.

Collectors desire protection for the rare or old comic books. As time passes, comic books and other historic memorabilia become lost or damaged. The chances of misplacing a comic book decrease when the book is held in a package display because of the conspicuousness of the display. Comic books mainly comprise paper products and can significantly deteriorate over time when exposed to air or water. Therefore, transparent covers protect the comic book and increase the book's longevity.

Transparent covers for collectible items in the prior art provide protection from air and water but detract from the collectible item's visual appeal. Moreover, many previous protective covers do not allow the substitution of different collectible items into the covers.

Moreover, the preservation of old comic books serves a historical interest. A package of an old comic book and matching figurine maintains a slice of historical popular culture. Even though comic books are typical fiction, the books often have a moral or symbolic message commenting on contemporary social issues.

It is therefore an object of the invention to provide an improved package including a figurine, a replica book or magazine bearing information related to the figurine and a display stand.

It is a further object of the invention to provide an improved package for securely packaging a figurine, a replica book or magazine and a display stand in a small and attractive display.

It is another object of the invention to provide a novel kit including a figurine, a replica book or magazine and a display stand.

It is yet another object of the invention to provide a novel package that securely packages a figurine, a replica book or magazine bearing related information and a display stand in preferred display orientations.

It is yet another object of the invention to provide a novel package that enables a consumer prior to purchasing the collectible item to view the package in the intended display arrangement.

It is yet another object of the invention to provide a novel package that improves the aesthetics and the visual appeal of a collectible item.

Other objects, features and advantages of the present invention will be apparent from the following description of the preferred embodiments, taken in conjunction with the accompanying drawings described below wherein like components have like numerals throughout several views.

DETAILED DESCRIPTION OF PREFERRED EMBODIMENTS

Figure 1:
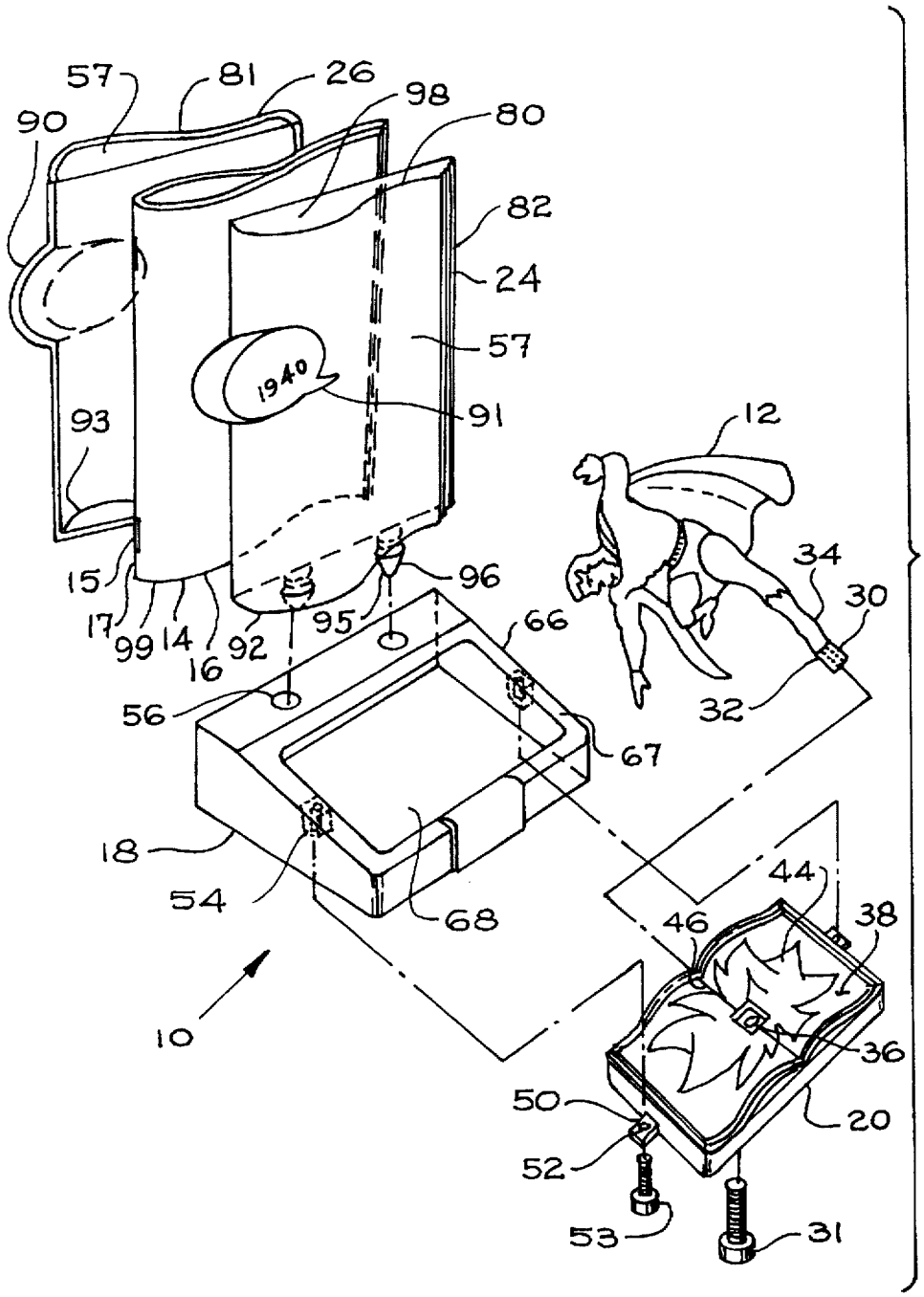
FIG. 1 is an exploded isometric view of a package constructed in accordance with one preferred embodiment of the invention.
Figure 2:
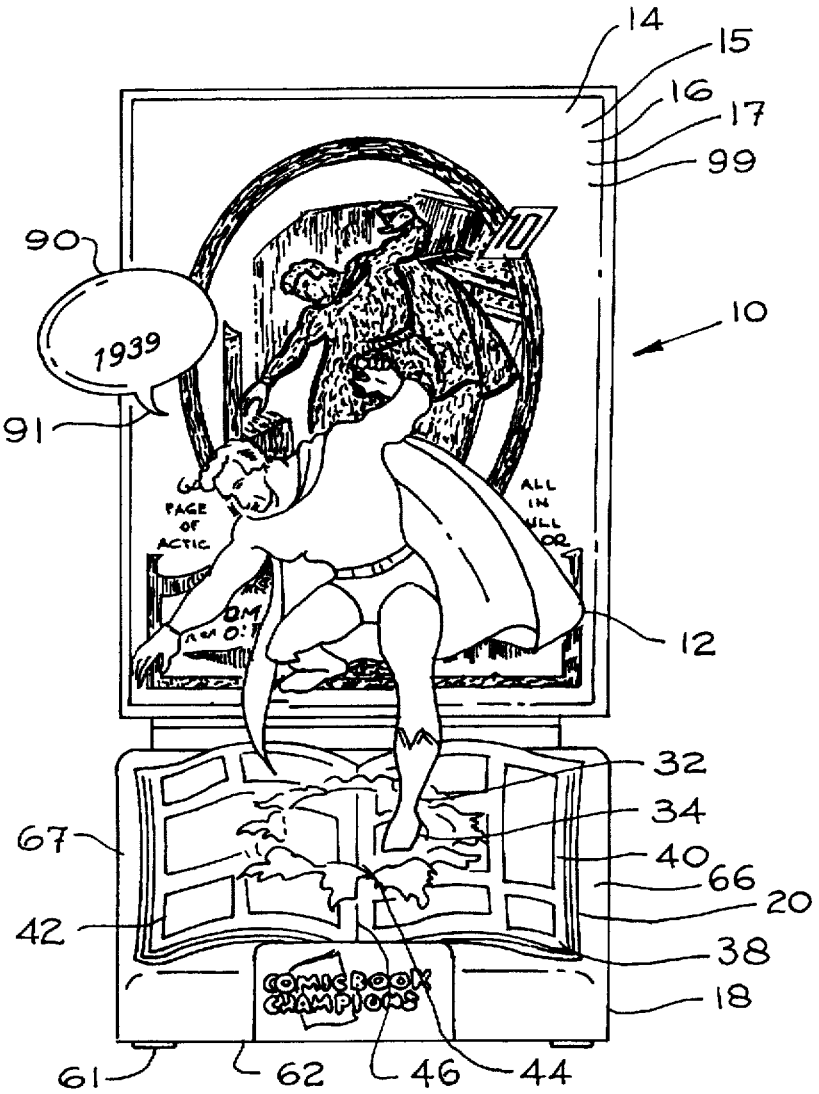
FIG. 2 is a front view of the package shown in FIG. 1.
Figure 3:
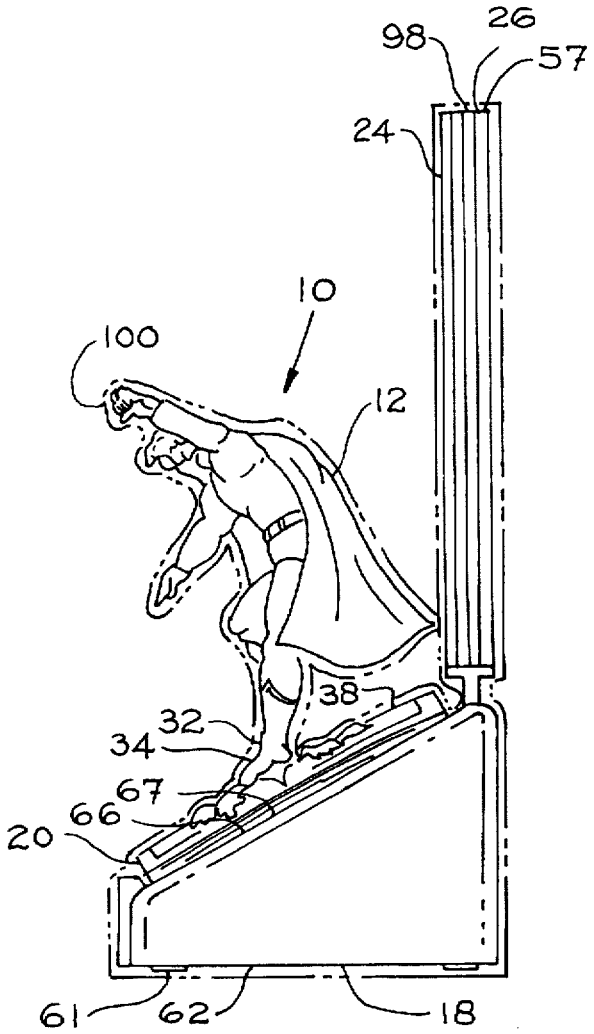
FIG. 3 is a side view of the package shown in FIG. 1.
Figure 4:
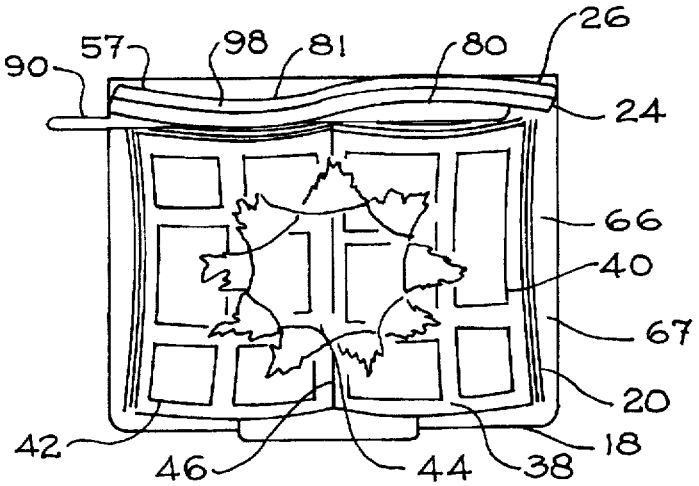
FIG. 4 is a top view of the package shown in FIG. 1.

Referring to the Figures and more particularly to FIG. 1, a package constructed in accordance with one preferred embodiment of the invention is illustrated at 10. The package 10 preferably includes a figurine 12, a model book 14 or a model magazine 16, a display stand 18, a base 20, a front cover 24 and a rear cover 26. The components 12, 14, 16, 18, 20, 24, 26 can be manufactured separately in multiple pieces and connected together to form an integrated unit as shown in FIGS. 2 through 4. Alternatively, one or more of the components can be integrally manufactured.

The figurine 12, the model book 14 or the model magazine 16 and the display stand 18 form a collectible item. Typically, a manufacturer of the package 10 assembles the components. However, a purchaser can assemble the separate parts and create the package 10.

As shown in FIG. 1, the figurine 12 can be connected to the base 20 so that the figurine 12 stands in an upright position adjacent the base 20. The display stand 18 supports and locates the front cover 24, the rear cover 26 and the base 20 in an attractive display position. The front cover 24 and the rear cover 26 are connected to enclose the model book 14 or the model magazine 16 or at least a portion of same. In accordance with one preferred embodiment of the invention, the three-dimensional figurine 12 is positioned in front of the model book 14 or the model magazine 16, providing a visually attractive display.

The figurine 12 can comprise a variety of figures. Preferably, the figurine 12 represents a character in the related model book 14 or model magazine 16 of the package 10. For example, the figurine 12 can represent a comic book figure or a sports figure and the model book 14 or the model magazine 16 can comprise a comic book 15 or a sports magazine 17 respectively. However, it will be apparent to one of ordinary skill in the art that the figurine 12 can represent many other characters or persons.

The figurine 12 can be fabricated from a wide variety of materials in a wide variety of shapes and sizes. Appropriate materials allow the figurine 12 to be substantially nondeforming, paint gripping and resistant to fracture. A molding process produces figurines 12 preferably comprising pewter. In an alternative embodiment, the figurine comprises metal, zinc alloy, plastic, rubber or other materials well known in the art. Preferably, a precise die mold produces the extensively detailed figurine 12. The figurine 12 can be painted with colors corresponding to the book or magazine character or can be left unpainted. In addition, an acrylic finish applied to the figurine 12 prevents peeling or cracking of the paint and gives the figurine 12 a shiny or glossy appearance.

A threaded engagement or other suitable connection well known in the art couples the figurine 12 to the base 20. As shown in FIG. 1, the combination of threads 30 on a proximal end 32 of the figurine 12 and a corresponding threaded hole 36 in the base 20 enables the threaded engagement of the figurine 12 to the base 20. An alternative coupling mechanism comprises a self threading fastener 31. In one preferred embodiment of the invention, the proximal end 32 of the figurine 12 represents a foot 34; thus, the figurine 12 appears to stand on or leap from the base 20.

In one preferred embodiment, the base 20 comprises an integral unit formed in the shape of an open book, although other shapes can also be used. A top surface 38 of the base 20 represents two visible pages of the open book. As shown in FIGS. 2 and 4, rectangles 40 and squares 42 formed on the top surface 38 represent blocks of text. Preferably, the pages appear torn and peeled back from an area 44 centered near a crease 46 between the pages. The figurine 12 connects to the base 20 in this area 44 creating the image of the character or person exploding from the two-dimensional pages of the base 20 and transforming into a three-dimensional figurine 12.

The base 20 can comprise various materials, such as pewter, metal, zinc alloy, plastic and other materials well known in the art. Preferably a molding process creates the base 20. The cast form of the base 20 can be manufactured with less precision than the figurine 12 since the base 20 serves only as background for the figurine 12. As with figurine 12, the base 20 preferably grips paint, resists fractures and does not deform significantly. The color of the base 20 provides an attractive background for the colors of the figurine 12. An acrylic finish improves the visual appeal of the base 20.

As shown in FIG. 1, the base 20 includes a threaded drilled or formed hole 36 in the centered mock explosion area 44 for threaded engagement of the figurine 12. Additionally, the base 20 can include a plurality of adjoining tabs 50. Preferably, threaded holes 52 in the tabs 50 match threaded holes 54 in the display stand 18, enabling a plurality of threaded fasteners 53 to couple the base 20 to the display stand 18. In an alternative embodiment, the base 20 can frictionally engage the display stand 18. In this embodiment, a recessed area 68 in the display stand 18 retains the base 20. Other connection methods well known in the art can couple the base 20 to the figurine 12 and to the display stand 18.

In an alternative embodiment, the base 20 comprises a book with paper pages modified to couple to the figurine 12 and to the display stand 18. A covering of a plastic transparent sheet or a like material sheet or a sealant protects the pages and cover of the base 20 from air and water exposure. In this embodiment, modifications to the base 20 enable connections with the figurine 12 and the display stand 18. For example, drilled or formed holes in the base 20 allow a threaded or bolted engagement.

In yet another alternative embodiment of the invention, the package 10 excludes the base 20 and the figurine 12 couples directly to the display stand 18. In this case, the display stand 18 can exclude the recessed area 68. Additionally, the display stand 18 can comprise an integrated stand and base 20 with the figurine 12 appearing to leap from the base 20 portion of the integrated stand.

The display stand 18 supports the package 10 and positions various components. A flat and substantially large bottom surface 62 of the display stand 18 provides a steady foundation and reduces the likelihood of tipping or overturning the package 10. A plurality of bumpers 61 can be connected to the bottom surface 62 preventing the display stand 18 from scratching the surface upon which the package 10 rests. As shown in FIGS. 1 through 3, the display stand 18 includes an inclined portion 66 to position the figurine 12 at lower height relative to the model book 14 or the model magazine 16 enabling simultaneous viewing of the figurine 12 and a majority of the model book 14 or the model magazine 16. Preferably, the recessed area 68 of the inclined portion 66 holds the base 20 and keeps the top surface 38 of the base 20 mostly level with a top surface 67 of the inclined portion 66.

In an alternative embodiment of the invention, letters or numbers inscribed or written on the display stand 18 identify the figurine 12 or list a serial number in a limited edition package 10. The serial numbers are preferably selected from a sequence of numbers and relate to one particular type of figurine 12. For example, a sequence of serial numbers is produced for sale along with a certain number of figurines 12. Other components of the package 10 bear the serial number and can include additional figurine information. The range of serial numbers and corresponding production of the packages 10 are preferably limited to provide a more valuable collector's edition product.

Preferably, the display stand 18 comprises an inexpensive and heavy plastic material. Alternatively, the display stand 18 can comprise other weighty materials such as metal or zinc alloy. A molding or extrusion process can form the display stand 18 with the surface of the display stand 18 having a substantially smooth and attractive finish. The display stand 18 can comprise a variety of colors, preferably complimentary to the colors of the base 20 and figurine 12 producing an attractive background.

The display stand 18 includes a plurality of holes 54 for coupling the base 20 and a plurality of holes 56 for coupling the front cover 24 and the rear cover 26. The holes 54, 56 can be molded or machined into the display stand 18. Threaded or frictional engagements or other connections well known to one of ordinary skill in the art connect the front cover 24, the rear cover 26 and other components 12, 20 to the display stand 18.

The front cover 24 and the rear cover 26 preferably comprise substantially transparent sheets 57 which protect the model book 14 or the model magazine 16 while coupling the model book 14 or the model magazine 16 in the package 10. Moreover, the front cover 24 and the rear cover 26 comprise a substantially nondeforming material to support the model book 14 or the model magazine 16 in an upright position. Certain plastics, such as styrene, are well suited as substantially transparent and nondeforming materials for the front cover 24 and the rear cover 26. Other substantially transparent, crack and scratch resistant and nondeforming materials, such as glass, can be used.

As shown in FIGS. 1 and 4, the front cover 24 can have a curved surface 80 that bends the model book 14 or the model magazine 16, enhancing the overall visual appearance of the package 10. The rear cover 26 contains a corresponding curved surface 81. Steps 82 formed in the front cover representing pages can be included as well.

Preferably, the front cover 24 and/or the rear cover 26 include a dialogue oval 90 formed into the plastic sheets, providing space for words typifying comic book dialogue. As shown in FIGS. 1 and 2, the dialogue oval 90 includes a leader area 91 further indicating that words in the dialogue oval 90 represent comic book dialogue. Information regarding the figurine 12 and the model book 14 or the model magazine 16 can be written on the dialogue oval 90; i.e., the year of the comic book and its main character.

A bottom surface 92 of the front cover 24 or a bottom surface 93 of the rear cover 26 preferably includes a pair of snap and lock connections 96 or other frictional coupling mechanisms for attachment to the display stand 18. Use of a threaded engagement connecting the front cover 24 to the display stand 18 is disfavored, since an aligned orientation of the front cover 24 relative to the figurine 12 is important for visual appeal of the package 10. In one preferred embodiment, a male end 95 of the coupling mechanism 96 is molded into the front cover 24. In an alternative embodiment, the male end 95 of the coupling mechanism 96 glues or otherwise connects to the front cover 24 by means well known in the art.

The front cover 24 and the rear cover 26 create an enclosure 98 to hold the model book 14 or the model magazine 16. A plurality of books 14 and/or magazines 16 can fill the sufficiently spacious enclosure 98 in an alternative embodiment.

Preferably, the model book 14 or the model magazine 16 comprises a small (about three inch by four inch) replica comic book 99. The package 10 includes the replica comic book 99 primarily for display purposes. Therefore, blank pages inserted between the reproduced covers of the replica comic book 99 can reduce manufacturing costs while maintaining the package's 10 visual appeal. The small replica comic book 99 befits the diminutive figurine 12 producing the overall compact package 10 which increases display and storage opportunities.

The replica comic book 99 or the comic book 15 mainly comprises paper products with overlaid ink or newsprint text, drawings and graphics. Preferably, a laminated or otherwise bonded front and back cover gives the covers more longevity and rigidity than the inner paper pages.

In an alternative embodiment, the model book 14 or the model magazine 16 can comprise an originally published comic book 15 or a conventional sized (approximately eight inch by eleven inch) reproduction thereof. The size of the concomitant components of the package 10 are comparative to the size of the comic book 15 producing an attractive package 10. Display of an old or rare comic book 15 produces a valuable collectible item.

The front cover 24 and the rear cover 26 detachably couple, enabling a collector to interchange various books or magazines into the package 10. For example, a collector with multiple comic books 15 depicting the same character can substitute various comic books 15 into the package 10. Moreover, the package 10 can market with a full sized replica comic book 99, and a collector possessing an old or rare comic book 15 can substitute the comic book 15 in place of the replica comic book 99. The front cover 24 and the rear cover 26 can couple using a variety of means, such as a snap and lock connection, a hook and latch connection, and other means well known in the art.

In another alternative embodiment, a wrapper 100 forms an enclosure retaining the package 10 components. The wrapper 100 can comprise a wide variety of materials, preferably a conventional preformed transparent plastic. The enclosure can conform to the contours of the figurine 12, the display stand 18, the base 20, the front cover 24 and the rear cover 26.

Accordingly, the present invention provides a secure and attractive package 10 for displaying the figurine 12 and related model books 14 or model magazines 16. In the most preferred embodiments of the invention, the package 10 enables the figurine 12 and model books 14 or model magazines 16 to be positioned in preferred display orientations for optimal visual impact. While preferred embodiments of the invention have been shown and described, it will be clear to those skilled in the art that various changes and modifications can be made without departing from the invention in its broader aspects as set forth in the claims provided hereinafter.

What is claimed is:

1. A package having a front and a back, said package comprising:

a display stand;

a figurine coupled to the display stand; and at least one of a model book and a model magazine bearing information relating to said figurine and being coupled to the display stand, the display stand locating said at least one of said model book and said model magazine in a display position relative to said figurine which provides a prominent display orientation for said at least one of said model book and said model magazine and for said figurine when viewed from the front of the package.

2. The package as defined in claim 1, further including a base disposed adjacent said figurine with said base coupled to said display stand.

3. The package as defined in claim 2, wherein said figurine is coupled to said base.

4. The package as defined in claim 3, wherein said base includes a top surface formed to represent pages of an open book, and wherein said top surface includes an opening adapted for engaging said figurine.

5. The package as defined in claim 2, further including a wrapper for retaining said figurine, said at least one of said model book and said model magazine, said display stand and said base.

6. The package as defined in claim 1, further including a front cover and a rear cover, said front cover being coupled to said rear cover forming a structure for enclosing only said at least one of said model book and said model magazine.

7. The package as defined in claim 6, wherein at least one of said front cover and said rear cover is coupled to said display stand.

8. The package as defined in claim 7, wherein said one of said front cover and said rear cover includes a coupling mechanism for attaching said one of said front cover and said rear cover to said display stand.

9. The package as defined in claim 1, wherein said figurine comprises a comic book figure.

10. The package as defined in claim 1, wherein said model magazine comprises a comic book.

11. The package as defined in claim 10, wherein said comic book comprises a replica comic book dimensioned smaller than a conventional comic book.

12. The package as defined in claim 1, wherein said display stand comprises plastic.

13. The package as defined in claim 1, wherein said figurine and said display stand bear related information.

14. The package as defined in claim 1, wherein said figurine comprises a sports figure.

15. The package as defined in claim 1, wherein said model magazine comprises a sports magazine.

16. A package comprising:

a figurine;

at least one of a model book and a model magazine bearing information relating to said figurine;

a front cover and a rear cover, said rear cover having a front surface and a back surface, said front cover and said rear cover being coupled together to form a support structure for supporting a portion of said at least one of said model book and said model magazine with said at least one of said model book and said model magazine located forwardly of the front surface of said rear cover; and a display stand coupled to said figurine and to said support structure, said display stand supporting said support structure in a display position relative to said figurine which provides a prominent display orientation for said at least one of said model book and said model magazine and said figurine in the package.

17. The package as defined in claim 16, further including a base coupled to said display stand and to said figurine.

18. The package as defined in claim 17, further including a wrapper for retaining said figurine, said at least one of said model book and said model magazine, said display stand and said base, with said wrapper including an enclosure substantially conforming to contours of said figurine.

19. The package as defined in claim 16, wherein said display stand bears information related to said figurine and said display stand comprises plastic.

20. The package as defined in claim 16, wherein said figurine comprises a comic book figure.

21. The package as defined in claim 16, wherein said model magazine comprises a replica comic book dimensioned smaller than a conventional comic book.

22. The package as defined in claim 16, wherein said front cover and said rear cover comprise a plurality of substantially transparent sheets mounted adjacent said at least one of said model book and said model magazine.

23. A package comprising:

a comic book figurine and a small replica comic book featuring a character upon which said comic book figurine is modeled;

a display stand including a base coupled to said comic book figurine;

a front cover and a rear cover, said front cover and said rear cover comprising a plurality of substantially transparent sheets enclosing only said small replica comic book, with at least one of said front cover and said rear cover being coupled to said display stand; and a wrapper forming an enclosure for retaining said comic book figurine, said small replica comic book, said display stand, said base, said front cover and said rear cover.

24. A package comprising:

a figurine;

a display stand coupled to said figurine;

at least one of a model book and a model magazine bearing information featuring said figurine; and a front cover and a rear cover, at least one of said front cover and said rear cover being coupled to said display stand, and said front cover and said rear cover being coupled together forming an enclosure for substantially enclosing only said at least one of said model book and said model magazine on said display stand.

25. The package as defined in claim 24, further including a wrapper forming an enclosure for retaining said figurine, said display stand, said front cover and said rear cover, and said at least of said model book and said model magazine.

* * * * *